US005172439A

United States Patent [19]

Farley

[11] Patent Number: 5,172,439

[45] Date of Patent: Dec. 22, 1992

[54] THERAPEUTIC MATTRESS OVERLAY AND METHOD OF FORMING AND USING THE SAME

[76] Inventor: David L. Farley, 18672 Evergreen Ave., Yorba Linda, Calif. 92686

[21] Appl. No.: 714,375

[22] Filed: Jun. 10, 1991

[51] Int. Cl.[5] ..... A47L 27/15

[52] U.S. Cl. ..... 5/465; 5/464; 5/481

[58] Field of Search ..... 5/437, 443, 446, 447, 5/448, 464, 481, 465, 903

[56] References Cited

U.S. PATENT DOCUMENTS

| | | | |
|---|---|---|---|
| 988,117 | 3/1911 | Leonard | 5/465 |
| 3,243,828 | 4/1966 | McCarty | 5/437 |
| 3,639,927 | 2/1972 | Munch | 5/465 X |
| 4,528,706 | 7/1985 | Branker | 5/481 X |
| 5,033,433 | 8/1991 | Farley | 5/481 X |

FOREIGN PATENT DOCUMENTS

| | | | |
|---|---|---|---|
| 242467 | 11/1925 | United Kingdom | 5/465 |
| 687625 | 2/1953 | United Kingdom | 5/447 |
| 903336 | 8/1962 | United Kingdom | 5/447 |

*Primary Examiner*—Michael F. Trettel
*Attorney, Agent, or Firm*—Stetina and Brunda

[57] ABSTRACT

A therapeutic mattress overlay for supporting anatomical portions of a recumbent human body such that weight is redistributed away from areas suffering from disorders due to injury and/or pathological conditions to promote healing thereof. The therapeutic mattress overlay comprises a first layer and a second layer disposed beneath the first layer and in laminar juxtaposition therewith such that the second layer may be configured to provide an area of increased thickness to support an anatomical body portion. A third layer may be disposed beneath the second layer and in laminar juxtaposition therewith. Convolutions may be formed in the first layer to provide areas of less resistance to accommodate protruding portions of the human body.

15 Claims, 1 Drawing Sheet

Fig. 1
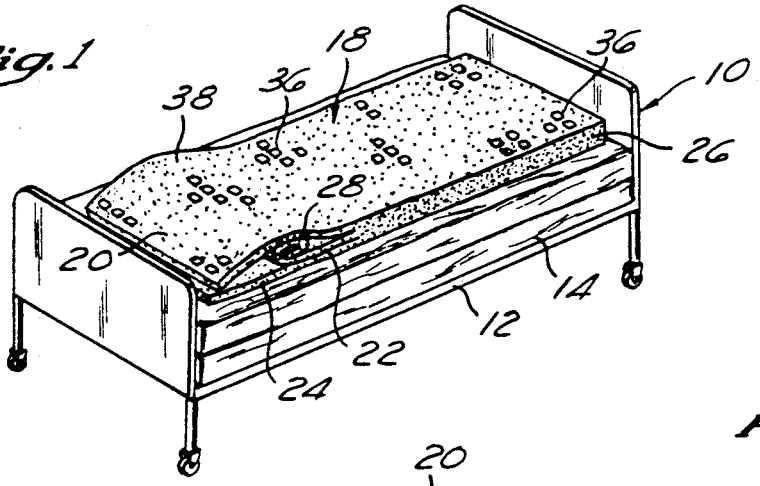
Fig. 2
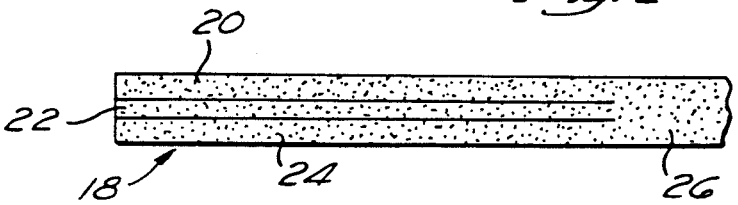
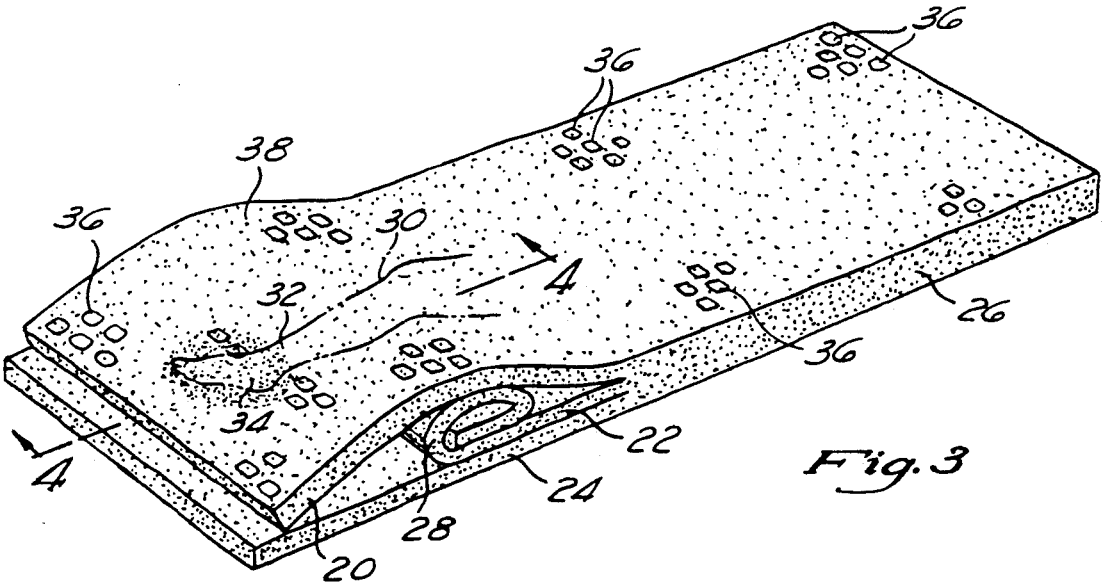
Fig. 3
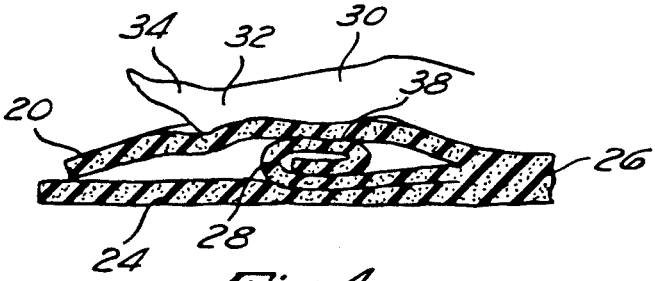
Fig. 4

THERAPEUTIC MATTRESS OVERLAY AND METHOD OF FORMING AND USING THE SAME

FIELD OF THE INVENTION

The present invention relates generally to therapeutic support pads, and more particularly to a therapeutic mattress overlay for supporting anatomical body portions, e.g. the lower extremities, of a recumbent human body such that weight is redistributed away from desired areas to prevent the formation of pressure ulcers thereon and to promote healing of disorders due to trauma and/or pathological conditions.

BACKGROUND OF THE INVENTION

Two of the primary causes of pressure (decubitus) ulcers are pressure and moisture. Pressure results from the supporting surface resisting the force of gravity on the body. For mattresses, this pressure is typically the highest beneath the shoulder (the scapulae) and tail (the sacrum and trochanter), generally the areas of greatest mass and projection. Other areas subject to substantial pressure include the ankles, heel, and portions of the feet. In these high pressure areas, the pressure against the body can be sufficient to occlude the capillaries and lymph vessels, thereby preventing the circulation of oxygen and nutrients to the skin. In addition, because air flow over these skin areas is typically prevented due to the intimate contact of the surface of the mattress, greater amounts of moisture are excreted for the dissipation of heat and waste. Over a sufficient period of time, the combination of high pressure and moisture will lead to the formation of pressure ulcers.

In an effort to combat the formation of pressure ulcers among patients, hospitals utilize a number of types of bed pads for their patients who fall into high risk categories. These products include static air, water, and foam support pads. Although these pads cannot reduce the overall resistance of the mattress to the weight of the body, they can reduce the level of pressure on the areas of highest pressure by redistributing the load and allowing a greater portion of the pad to support the body. Each of these types of pads has different advantages and disadvantages.

Generally, static air and water support pads provide superior high pressure reduction capabilities at the bony prominences, but permit only limited air flow and heat dissipation. In (addition, both static air and water support pads require filling, are susceptible to leaks and tend to "bottom out" (i.e. permit the weight of the user to displace the air or water in the pad to the extent that the user is supported by the mattress, rather than by the air or water cushion). Static water support pads also are undesirable in that they are heavy and unwieldy to transport. While pumps and valves can be used to vary the pressure resistance of the static air and water pads over time, these features render the pad both expensive and difficult to install and transport.

Convoluted foam pads, on the other hand, are generally relatively inexpensive and easily transported, while providing superior air flow potential and moisture reduction capabilities. Unfortunately, despite considerable study and effort, it has proved exceedingly difficult to develop an easily manufactured convoluted foam pad which is capable of providing pressure reduction characteristics comparable to static air and water support pads.

The manufacture of convoluted foam pads continues to largely follow the methods taught by U.S. Pat. No. 3,431,802. The pads are typically formed by feeding a foam block between two cooperating parallel cylinders, each of which has an undulated surface. The cylinders rotate towards one another and are spaced so that the block inserted between them is compressed between the cylinders and is driven against a cutting edge which slices the block in half. Each half generally comprises alternating rows of peaks and valleys, in checkerboard fashion The resulting halves are perfectly matched so that when one half is laid upon the other, the tops of the peaks of one half rest against the floor of the valleys of the other half, thus forming a solid block. In addition, although it is possible to manufacture pads which are not the mirror image or reflection of one another, this is rarely done, as it would typically result in only one usable half, thereby significantly increasing material costs.

One convoluted foam pad currently in use is disclosed in U.S. Pat. No. 4,686,724. The pad comprises alternating columns of peaks and valleys in checkerboard fashion. Air channels are stamped, press cut or laser cut through the floor of the valleys to the bottom face of the pad, leaving removable plugs used to selectively control the amount of aeration and dissipation of body heat permitted by the pad.

In one embodiment, the peaks of the pad are "topped off" to create a broken flat surface, interposed with valleys, with the distance between the floor of each valley and the bottom surface of the pad being constant. Within each valley is a channel extending from the valley floor to the flat bottom face of the pad. The patent teaches that a skin area of 1.25 inches in diameter or less, even though denied air circulation, can sustain itself from air circulating in an adjacent area. Therefore, by limiting each peak top to a diameter of 1.25 inches or less, the occurrence of pressure ulcers can, according to the patent, be virtually eliminated. Unfortunately, the use of this uniform pad with its removable plugs has found little acceptance in practice, perhaps because the removal and replacement of the individual plugs is relatively difficult and time consuming.

Disorders due to trauma and/or pathological conditions frequently require redistribution of weight away from the affected body part to facilitate healing thereof. The redistribution of weight is commonly accomplished by supporting surrounding areas with pillows and/or pads. For example, the treatment of an injury to the ankle may include supporting the patient's leg such that little or no weight is supported by the injured ankle.

However, such practice suffers from several deficiencies. The pillows and/or pads must be properly positioned to provide the required support and must remain so positioned for a length of time. Positioning a plurality of pillows and/or pads is not always a simple task and may involve the stacking of several layers in order to achieve the desired results. Once properly positioned, such pillows and/or pads are subject to being moved by the patient or others such that they no longer perform the desired function. Additionally, the use of pillows and/or pads requires that a sufficient quantity of pillows and/or pads of the appropriate types be available when needed. It can often be a difficult and time-consuming task to locate suitable pillows and/or pads. Furthermore, the use of pillows and/or pads to redistribute weight results in an area of increased pressure where the pillows and/or pads contact the patient, potentially resulting in the formation of pressure ulcers at the site of contact. For example, pillows placed under a calf to remove weight from an injured ankle increase the pressure upon the calf.

Additionally, it is frequently necessary to reposition and/or fluff any pillows used to support an anatomical body portion in order to obtain the optimum benefit therefrom. Pillows typically tend to become compacted or compressed during such use and thus loose a degree of their effectiveness. The compacted or compressed pillows both permit settling of the supported anatomical body portion, thus possibly allowing it to contact the mattress in an undesirable manner, and they also apply a greater amount of pressure to the supported anatomical portion than desired. Fluffing of the pillows necessarily requires that they be repositioned. Thus, the use of pillows to provide support to an anatomical body portion to facilitate healing of disorders due to injury and/or pathological conditions requires the frequent attention of administering personnel.

As such, in view of the deficiencies of the prior art, it would be desirable to provide a means for supporting anatomical body portions suffering from disorders due to trauma and/or pathological conditions such that weight is redistributed away from the affected area wherein the supported anatomical body portion is not subject to an increased likelihood of incurring pressure ulcers.

SUMMARY OF THE INVENTION

The present invention specifically addresses and alleviates the above-mentioned deficiencies associated in the prior art. More particularly, the present invention comprises a therapeutic mattress overlay for supporting anatomical portions of a recumbent human body such that weight is redistributed away from areas suffering from disorders due to injury and/or pathological conditions to promote healing thereof. The therapeutic mattress overlay comprises a first layer and a second layer disposed beneath the first layer and in laminar juxtaposition therewith such that the second layer may be configured to provide an area of increased thickness to support an anatomical body portion. A third layer may be disposed beneath the second layer and in laminar juxtaposition therewith. Convolutions may be formed in the first layer to provide areas of less resistance to accommodate protruding portions of the human body.

Thus, the present invention provides a means for supporting an anatomical body portion such that weight is removed from a desired area and such that the supported anatomical body portion is not subject to a substantially increased probability of the formation of pressure ulcers.

BRIEF DESCRIPTION OF THE DRAWINGS

FIG. 1 is a perspective view of a bed having a therapeutic mattress overlay disposed thereon;

FIG 2 is a sectional view of the foot end portion of a therapeutic overlay of the present invention showing the first, second, and third layers thereof;

FIG. 3 is an enlarged perspective view of the therapeutic mattress overlay of FIG. 1 showing the second layer configured to provide an area of increased thickness to support a patient's lower extremeties; and FIG. 4 is a cross-sectional view of the foot end portion of the therapeutic mattress overlay of FIG. 3.

DETAILED DESCRIPTION OF THE PREFERRED EMBODIMENT

The detailed description set forth below in connection with the appended drawings is intended as a description of the presently preferred embodiment of the present invention, and is not intended to represent the only form in which the present invention may be constructed or utilized. The description sets forth the functions and sequences of steps for constructing and operating the invention in connection with the illustrated embodiment. It is to be understood, however, that the same or equivalent functions and sequences may be accomplished by different embodiments that are also intended to be encompassed within the spirit and scope of the invention.

The therapeutic mattress overlay of the present invention is illustrated in FIGS. 1–4 which depict a presently preferred embodiment of the invention. Referring now to FIG. 1, the therapeutic mattress overlay 18 of the present invention is typically disposed upon a bed 10 having a frame 12, box springs 14, and a mattress 16. The therapeutic mattress overlay 18 is comprised generally of a first or uppermost layer 20, a second or intermediate layer 22, and a third or lowermost layer 24. The first 20, second 22, and third 24 layers converge to a common or single layer 26. In the preferred embodiment of the present invention the first 20, second 22, and third 24 layers define the lower portion, i.e. leg portion, of the therapeutic mattress overlay and the single or common layer 26 defines the upper portion, i.e. body portion, thereof. The therapeutic mattress overlay of the presently preferred embodiment is configured to support a patient's lower extremities such that pressure is removed from the ankles and feet thereof.

The particular configuration of the therapeutic mattress overlay of the present invention in the preferred embodiment for supporting the lower extremeties is by way of illustration only and not by way of limitation. Those skilled in the art will recognize that various configurations are possible for supporting various anatomical portions of the human body to relieve pressure from various other anatomical portions of the human body.

At least a portion of the second layer 22 may be rolled or folded to provide an area of increased thickness 38. Such rolling or folding of the second layer 22 causes a hump 28 to be formed in the therapeutic mattress overlay 18 to define the area of increased thickness 38 upon which the patient's lower extremeties may be supported.

Referring now to FIG. 2, the therapeutic mattress overlay 18 of the present invention may be formed by forming first 20, second 22, and third 24 layers within a single sheet of foam or other suitable resilient material. The first 20, second 22, and third 24 layers are formed such that the second layer 22 may be rolled or folded to configure the therapeutic mattress overlay to have an area of increased thickness (such as 38 of FIGS. 1, 3, and 4) at the desired location. Those skilled in the art will recognize that various means, e.g. hot wire or band saw, are suitable for forming the first 20, second 22, and third 24 layers from a single integral piece of material. Indeed, the first 20, second 22, and third 24 layers need not be formed from a single integral piece of material, but rather may be formed as separate sections and then attached together. Optionally, the third layer 24 may be omitted in those applications requiring less support.

Referring now to FIGS. 3 and 4, the therapeutic mattress overlay of the preferred embodiment of the present invention may be practiced by lifting the first layer 20 and rolling or folding of the second layer 28 such that an area of increased thickness 38 is provided at the desired location to support an anatomical body portion. As illustrated, the preferred embodiment of the present invention is configured to support a patient's lower extremity or leg 30 such that pressure is reduced on the patient's ankle 32 and foot 34 to facilitate healing thereof.

Convolutions 36 may be formed within the therapeutic mattress overlay of the present invention to provide at least one area of less resistance to weight than other areas of the pad such that protruding portions of a human body, i.e. hips and/or shoulders, may be disposed thereupon. The protruding portions of the human body may thus sink deeper into the therapeutic mattress overlay to be more uniformly supported thereby. Such convolutions may be formed according to the process disclosed in Applicant's U.S. Pat. No. 4,879,776, issued on Nov. 14, 1989, and entitled ANATOMICALLY CONFORMABLE FOAM SUPPORT PAD, the entire contents of which are expressly incorporated by reference.

The therapeutic mattress overlay of the present invention is preferably comprised of open cell expanded plastic polyurethane foam with a density of between 1 and 3 pounds per cubic foot. Peak thicknesses of the convolutions are preferably between 1 and 5 inches. Those skilled in the art will recognize that various resilient materials, preferably foamed polymers, are likewise suitable for the formation of (the therapeutic mattress overlay of the present invention.

In the preferred embodiment, the first layer 20 is between approximately ¾ inch and 3 inches thick, preferably approximately 1½ inches thick; the second layer 22 is between approximately ¾ inch and 3 inches thick, preferably approximately 1½ inches thick; and the third layer is between approximately ⅜ inch and 1½ inches thick, preferably approximately ¾ inch thick.

The areas providing less resistance comprise peaks arranged in rows, each row having a flat top and being spaced from any adjacent peak in the same row by a valley wherein each of the peaks has a substantially uniform peak thickness and the average valley thickness of the valleys in at least one area of less resistance is less than the average valley thickness of the valleys in other areas of the pad.

It is understood that the exemplary therapeutic mattress overlay of the present invention described herein and shown in the drawings represents only a preferred embodiment of the invention. Indeed, various modifications and additions may be made to such embodiment without departing from the spirit and scope of the invention. For example, the configuration need not be limited to that illustrated, but rather may be varied to accommodate various anatomical portions of the human body. Also, the mattress overlay pad of the present invention may be specifically configured for veterinary applications. Furthermore, the therapeutic mattress overlay of the present invention need not be comprised of a foam material, but rather may be composed of various resilient mattress or padding materials. Thus, these and other modifications and additions may be obvious to those skilled in the art and may be implemented to adapt the present invention for use in a variety of different applications.

What is claimed is:

1. A pad comprising:

(a) a first layer of resilient material;

(b) a separable second layer of resilient material maintained generally in laminar juxtaposition to said first layer during use of the pad, said second layer foldable to provide an area of increased thickness to support an anatomical body portion;

(c) a third layer of resilient material disposed generally in laminar juxtaposition to said second layer and attached thereto; and (d) wherein said first, second, and third layers are portions of a common piece of resilient material.

2. The pad as recited in claim 1 wherein:

(a) said first layer is between approximately ¾ and 3 inches thick;

(b) said second layer is between approximately ¾ and 3 inches thick; and (c) said third layer is between approximately ⅜ and 1 ½ inches thick.

3. The pad as recited in claim 2 wherein:

(a) said first layer is approximately 1½ inches thick;

(b) said second layer is approximately 1½ inches thick; and (c) said third layer is approximately ¾ inch thick.

4. The pad as recited in claim 1 wherein said first layer further comprises a plurality of convolutions.

5. The pad as recited in claim 1 wherein said first layer further comprises at least one area which provides less resistance to weight than other areas of said pad.

6. The pad as recited in claim 5 wherein said area providing less resistance corresponds to a protruding portion of a human body.

7. The pad as recited in claim 6 wherein:

(a) said area providing less resistance comprises peaks arranged in rows, each peak having a flat top and being spaced from any adjacent peak in the same row by a valley; and (b) wherein each of said peaks has a substantially uniform peak thickness and the average valley thickness of said valleys in at least one area of less resistance is less than the average valley thickness of said valleys in said other areas of least resistance.

8. A method for forming a therapeutic mattress overlay comprising the steps of forming first, second, and third layers of resilient material in laminar juxtaposition to one another such that a portion of said first, second, and third layers form a common single layer and such that a portion of said second layer may be configured to provide an area of increased thickness to support an anatomical body portion.

9. A method for forming a therapeutic mattress overlay comprising the steps of:

(a) cutting a single piece of foam material to form first, second, and third layers and to leave a single common layer; and (b) wherein a portion of said second layer may be configured to provide an area of increased thickness to support an anatomical body portion.

10. The method as recited in claim 9 further comprising the step of:

(a) forming areas of less resistance in said first layer, said areas of less resistance comprising peaks arranged in rows, each peak having a flat top and being spaced from any adjacent peak in the same row by a valley; and (b) wherein each of said peaks has a substantially uniform peak thickness and the average valley thickness of said valleys in at least one area of less resistance is less than the average valley thickness of said valleys in other areas of least resistance.

11. A method for providing support to an anatomical body portion comprising the steps of:

(a) attaching at least three resilient foam sheets in laminar juxtaposition such that a portion of said sheets defines three separable layers and another portion of said sheets define a single common layer; and (b) wherein one of said layers may be configured to provide an area of increased thickness to support an anatomical body portion.

12. A method of using a therapeutic mattress overlay comprising the steps of:

(a) disposing a mattress overlay upon a mattress, said overlay comprising at least two separable layers and a common layer;

(b) configuring the lower-most layer of said overlay to provide an area of increased thickness such that said area of increased thickness is disposed at a desired location.

13. The method as recited in claim 12 wherein the step of configuring the lower-most layer comprises rolling lower-most layer.

14. The method as recited in claim 12 wherein the step of configuring the lower-most layer comprises folding the lower-most layer.

15. A pad comprising:

(a) a first layer of resilient material;

(b) a second layer of resilient material disposed generally in laminar juxtaposition to said first layer and attached thereto such that said second layer may be configured to provide an area of increased thickness to support an anatomical body portion;

(c) a third layer of resilient material disposed generally in laminar juxtaposition to said second layer and attached thereto; and (d) wherein said first, second, and third layers are portions of a common piece of resilient material.

* * * * *